US010535952B2

(12) United States Patent
Mamiya et al.

(10) Patent No.: US 10,535,952 B2
(45) Date of Patent: Jan. 14, 2020

(54) LEVER-TYPE CONNECTOR

(71) Applicant: Sumitomo Wiring Systems, Ltd., Yokkaichi, Mie (JP)

(72) Inventors: Yuma Mamiya, Mie (JP); Yujiro Imai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/987,191

(22) Filed: May 23, 2018

(65) Prior Publication Data

US 2018/0351295 A1 Dec. 6, 2018

(30) Foreign Application Priority Data

Jun. 6, 2017 (JP) ..... 2017-111253

(51) Int. Cl.
*H01R 13/629* (2006.01)
*H01R 13/422* (2006.01)

(52) U.S. Cl.
CPC ... *H01R 13/62977* (2013.01); *H01R 13/4223* (2013.01)

(58) Field of Classification Search
CPC ..... H01R 13/4223; H01R 13/4365; H01R 13/4538; H01R 13/629; H01R 13/62977; H01R 13/62938
See application file for complete search history.

(56) References Cited

U.S. PATENT DOCUMENTS 5,269,696 A * 12/1993 Okada ..... H01R 13/62933 439/140
6,095,833 A * 8/2000 Osawa ..... H01R 13/62933 439/157
6,305,990 B1 * 10/2001 Ward ..... H01R 13/432 439/752
6,422,881 B1 * 7/2002 Puhl ..... H01R 13/4538 439/140
7,467,958 B2 * 12/2008 Patterson ..... H01R 13/62944 439/157
9,520,669 B2 * 12/2016 Gerwatowski ..... H01R 13/44
10,181,679 B1 * 1/2019 Probert ..... H01R 13/6295
2002/0064984 A1 * 5/2002 Ishikawa ..... H01R 13/62933 439/157

(Continued)

FOREIGN PATENT DOCUMENTS

JP 3244034 10/2001

*Primary Examiner* — Oscar C Jimenez
(74) *Attorney, Agent, or Firm* — Gerald E. Hespos; Michael J. Porco; Matthew T. Hespos

(57) ABSTRACT

A lever (11) swings from a fitting start position to a fitting completion position on a housing (10) and has a cam groove (68). In the swinging process, a cam follower (21) of a counterpart housing (14) and cam (55) of a moving plate (13) advance a fitting operation between the housings (10) and (14) to move the moving plate (13) from a moving start position to a moving completion position. A detachment regulating portion (69) locks the cam (55) at the fitting start position to regulate detachment of the moving plate (13) from the hood (26). The lever (11) is swung from the fitting start position in an opposite direction of the fitting completion position, and has a detachment allowing position separating the cam (55) from the detachment regulating portion (69) to allow the moving plate (13) to detach from the hood (26).

11 Claims, 16 Drawing Sheets

(56) References Cited

U.S. PATENT DOCUMENTS

| | | | | |
|---|---|---|---|---|
| 2002/0127912 | A1* | 9/2002 | Hamai | H01R 13/5208 439/587 |
| 2002/0182908 | A1* | 12/2002 | Maegawa | H01R 13/62938 439/157 |
| 2003/0008537 | A1* | 1/2003 | Nishide | H01R 13/62933 439/157 |
| 2006/0051994 | A1* | 3/2006 | Fujii | H01R 13/62938 439/157 |
| 2007/0128900 | A1* | 6/2007 | Bauman | H01R 13/62955 439/157 |
| 2008/0102667 | A1* | 5/2008 | Ikeya | H01R 13/62938 439/157 |
| 2008/0102668 | A1* | 5/2008 | Ikeya | H01R 13/62938 439/157 |
| 2010/0159734 | A1* | 6/2010 | Horiuchi | H01R 13/514 439/374 |
| 2013/0330959 | A1* | 12/2013 | Bashkin | H01R 13/62944 439/372 |

* cited by examiner

LEVER-TYPE CONNECTOR

BACKGROUND

Field of the Invention

The invention relates a lever-type connector.

Description of the Related Art

Japanese Patent Publication No. 3244034 discloses a lever-type connector that includes a male housing having a hood in which a counterpart female housing can be fit. The male housing has a male terminal fitting with a tab projecting into the hood. A lever is supported swingably at a fitting start position and a fitting completion position with respect to the male housing. Additionally, a moving plate is arranged movably at a tab holding position (moving start position) and a holding canceling position (moving completion position) in the hood. The moving plate has a positioning hole at which the tab of the male terminal fitting is positioned and into which the tab can be inserted so that the distal end of the tab projects through the positioning hole at the tab holding position in a protected state.

Cam pins (cam follower and cam) are disposed on the female housing and a moving plate, respectively. The cam pins are in a coupling state and slide on a groove surface of a cam groove formed in the lever to exert a cam operation in the process of moving the lever from the fitting start position toward the fitting completion position. Thus, a fitting operation between the housings advances. In addition, the moving plate is interlocked with a swinging operation of the lever through the cam pins and moves from the tab holding position to the holding canceling position when fitting the housings. A bendable lance is disposed in the male housing and retains the male terminal fitting.

Although not shown in Japanese Patent Publication No. 3244034, in a normal state, a locking structure hooks and locks the cam pin of the moving plate on edge of the cam groove on a receiving port side (inlet port side) when the lever is at the fitting start position. The locking structure is configured to prevent the moving plate at the tab holding position from dropping out from the hood. However, the male terminal fitting may have to be removed from the housing for maintenance. Thus, the lever must be removed from the housing, and then the moving plate must be detached from the hood. In this state, a jig is caused to act on the lance to bend the lance, and a removing operation of the male terminal fitting must be performed. More specifically, before the detaching operation of the moving plate, the removing operation of the lever must be performed, and therefore the workload is disadvantageously heavy.

A jig insertion hole is formed in the moving plate, and the jig is inserted into the jig insertion hole to act on the lance. In this case, the detaching operation of the moving plate and the removal of the lever need not be performed, thereby solving the problem of the workload. However, the jig insertion hole complicates the structure, and resin fluidity is deteriorated. Accordingly, a shaping property of the moving plate may be deteriorated. In addition, a front retainer may be interposed between the plate surface of the moving plate and the back surface of the hood. Thus, a jig insertion hole must be formed in the front retainer, and the structure becomes further complex.

The invention is completed on the basis of the above circumstance and has as its object to perform a removing operation of a male terminal fitting in a lever-type connector in which a moving plate is interlocked with a lever without removing the lever from a housing.

SUMMARY

The invention relates to a lever-type connector comprising: a housing having a hood into which a mating housing can be fit. At least one tab of a male terminal fitting projects into the hood. A moving plate is arranged in the hood and can move between a moving start position and a moving completion position. The moving plate has at least one insertion hole at which the tab is positioned and into which the tab is inserted. The tab projects forward from the insertion hole when the moving plate moves from the moving start position to the moving completion position. The connector has at least one cam element to be coupled to a mating cam element provided at the mating housing. A lever is supported to be displaced from a fitting start position to a fitting completion position with respect to the housing. The mating cam element and the cam element engage to advance a fitting operation between the housings as the lever moves from the fitting start position to the fitting completion position. An engageable cam also moves the moving plate toward the moving completion position and has at least one detachment regulating portion locking the cam element at the fitting start position to control detachment of the moving plate from the hood. The lever is displaced from the fitting start position in an opposite direction of the fitting completion position side, and has a detachment allowing position at which the cam element is separated from the detachment regulating portion to allow the moving plate to detach from the hood.

At least one stopper receiving portion may be disposed in or at the housing, and at least one stopper may be disposed on at least one cam plate of the lever. The stopper may be locked on the stopper receiving portion at the fitting start position and may control displacement of the lever to the detachment allowing position. The cam plate may be deformed elastically to cancel locking between the stopper receiving portion and the stopper. Specifically, the stopper receiving portion may be disposed in a housing and may be locked on a cam plate of a lever at a fitting start position. The stopper may regulate swinging of the lever to the detachment allowing position, and the cam plate may be deformed elastically to cancel the locking between the stopper receiving portion and the stopper. The locking state between the stopper receiving portion and the stopper may be maintained to prevent the lever from swinging unexpectedly from the fitting start position to the detachment allowing position. The locked state between the stopper receiving portion and the stopper can be canceled merely by elastically deforming the cam plate. Thus, the canceling operation is not especially difficult.

At least one guide groove may be formed in at least one of a cam plate of the lever and the housing to guide a jig for elastically or resiliently displacing the cam plate. The at least one guide groove extends substantially straight and opens on an outer surface side. Accordingly, the cam plate easily can be displaced elastically or resiliently merely by applying the jig along the guide groove.

At least one flexible lance may be disposed at the housing to retain and lock the male terminal fitting.

A front retainer may be arranged in the hood so that at least part of the front retainer is sandwiched between a plate surface of the moving plate and a back surface of the hood. The front retainer may have at least one bending controlling portion for controlling a bending operation of the lance.

The formation of a jig insertion hole in the front retainer for receiving a terminal removing jig could deteriorate the resin fluidity of the front retainer. In particular, the front retainer has the bending regulating portion for regulating bending of the lance, and an opening area of the jig insertion hole would overlap the bending regulation portion. For this reason, the jig insertion hole would not be opened easily. However, the front retainer of the subject invention is detached from the hood while the lever is attached to the housing, and the male terminal fitting can be removed in this state. For this reason, the front retainer does not need a jig insertion hole.

At least one arc-like groove may be formed in the lever and may be curved along a swinging direction of the lever, and an interference portion may be disposed in the housing. The interference portion may be brought into contact with a back end of the arc-like groove at the detachment allowing position to control further swinging of the lever. The interference portion contacts the back end of the arc-like groove to stop the lever at the detachment allowing position, thereafter, the detaching operation of the moving plate can be performed rapidly.

The back end of the arc-like groove may defines a hitting surface on which the interference portion of the housing is struck when the lever substantially reaches the detachment allowing position.

One end of the detachment regulating portion may be connected to a side surface of the cam engageable element on an inlet port side of the engageable cam element, and/or a passing port may be formed between a side surface of the cam engageable element and the other end of the detachment regulating portion to open substantially in the forward and backward directions so that the cam element can pass.

Another aspect of the invention relates to a lever-type connector assembly comprising the above-described lever-type connector and a mating connector having a mating housing that is insertable into a hood of the housing of the connector.

The lever is swung from the fitting start position to the detachment allowing position to separate the cam from the detachment regulation portion when removing the male terminal fitting. In this state, the moving plate is detached from the hood. Thereafter, a jig for removing a terminal is caused to act on a lance or the like facing the back surface of the hood to make it possible to remove the male terminal fitting. Thus, the male terminal fitting can be removed without removing the lever to reduce a workload.

These and other objects, features and advantages of the invention will become more apparent upon reading the following detailed description and accompanying drawings. It should be understood that even though embodiments are described separately, single features thereof may be combined to additional embodiments.

DETAILED DESCRIPTION

Figure 1:
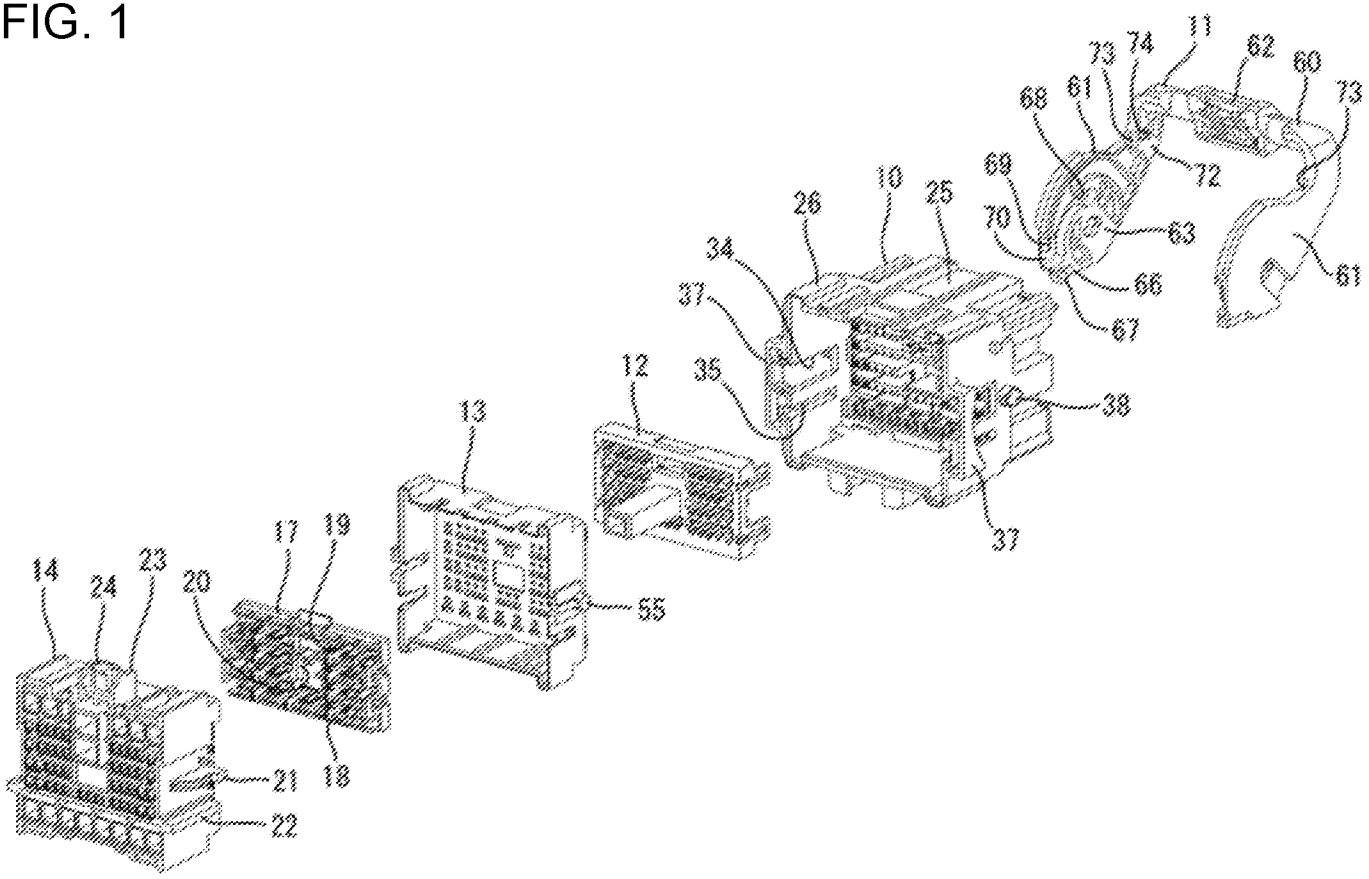
FIG. 1 is an exploded perspective view of a lever-type connector according to a first embodiment.

An embodiment of the invention will be described below with reference to FIGS. 1 to 17. A lever-type connector according to this embodiment, as shown in FIG. 1, includes a housing 10, a front retainer 12, and at least one moving plate 13. The housing 10 can be fit on a counterpart mating housing 14. In the following description, it is assumed that, with respect to forward and backward directions, substantially facing ends on which both housings 10 and 14 face each other at a start of fitting are defined as front ends. Vertical directions and horizontal directions mean up and down directions and width directions, respectively, and are defined on the basis of FIG. 3 and FIG. 17.

Figure 17:
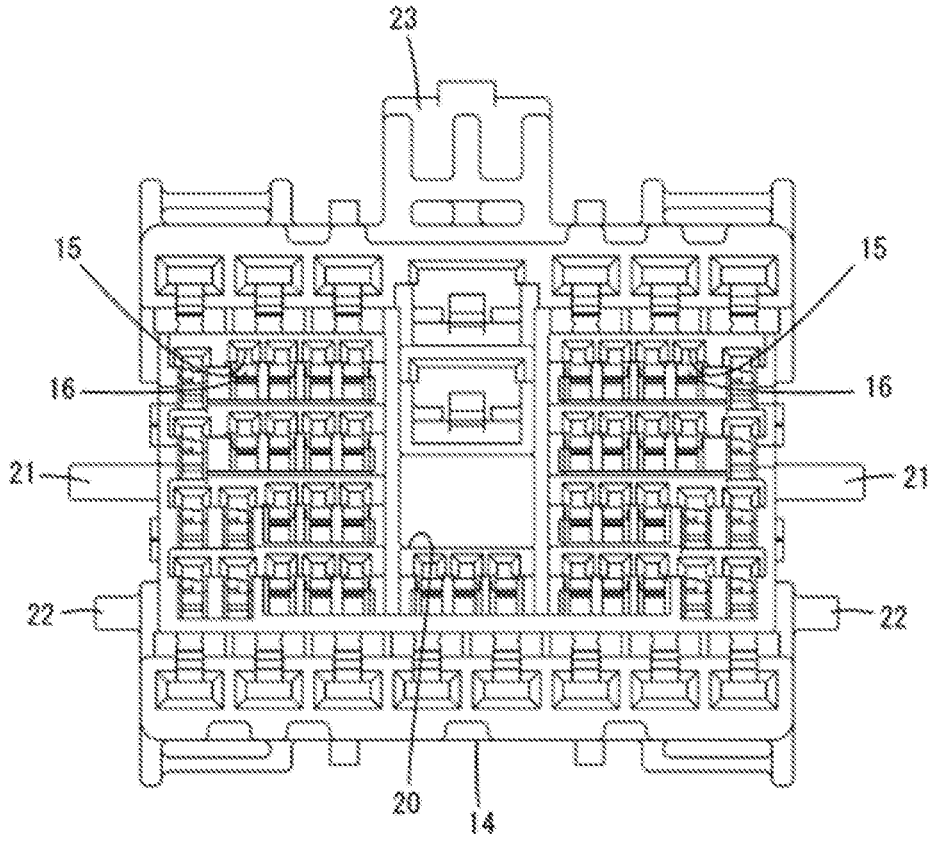
FIG. 17 is a front view of a counterpart housing.

The counterpart housing 14 is made e.g. of a synthetic resin and, as shown in FIG. 17, has a substantially rectangular-block-like shape. Counterpart cavities 15 are disposed to align in the vertical and horizontal directions in the counterpart housing 14. Each of the counterpart cavities 15 can receive a counterpart female terminal fitting (not shown) inserted from the back. A flexible or deflectable counterpart lance 16 is disposed in each of the counterpart cavities 15, and the female terminal fitting is locked resiliently or elastically on the counterpart lance 16 and held in the counterpart cavity 15.

A counterpart front retainer 17 is disposed to at least partly cover the front surface of the counterpart housing 14, as shown in FIG. 1. The counterpart front retainer 17 is made e.g. of a synthetic resin and has bending regulating portions 18 that enter into a bending space of each of the counterpart lances 16 when the front retainer 17 is disposed in the counterpart housing 14. The counterpart bending regulating portions 18 regulate bending of the counterpart lances 16 and maintain a state where the counterpart lances 16 are locked to the female terminal fittings.

Counterpart windows 19 are formed in the counterpart retainer 17 and communicate with the counterpart cavities 15. Furthermore, a push prevention receiving portion 20 is formed by opening or recessing (see FIG. 17) at a substantially center portion. The push prevention receiving portion 20 is formed at a position substantially corresponding to the front surface of the counterpart housing 14.

Cam followers 21 project from side surfaces of the counterpart housing 14 at substantially center positions in the vertical direction. The cam followers 21 have substantially flat-columnar shapes the horizontal directions. Canceling portions 22 project from lower parts of the side surfaces of the counterpart housing 14. Each canceling portion 22 has a plate-like shape extending in the forward and backward directions and is arranged substantially parallel with the cam followers 22.

A lock 23 projects from the rear part of the upper surface of the counterpart housing 14 and at a substantially central portion in the horizontal directions. As shown in FIG. 1, the lock 23 has a claw-like projection 24 that projects substantially back from the upper end portion of the main body.

Figure 2:
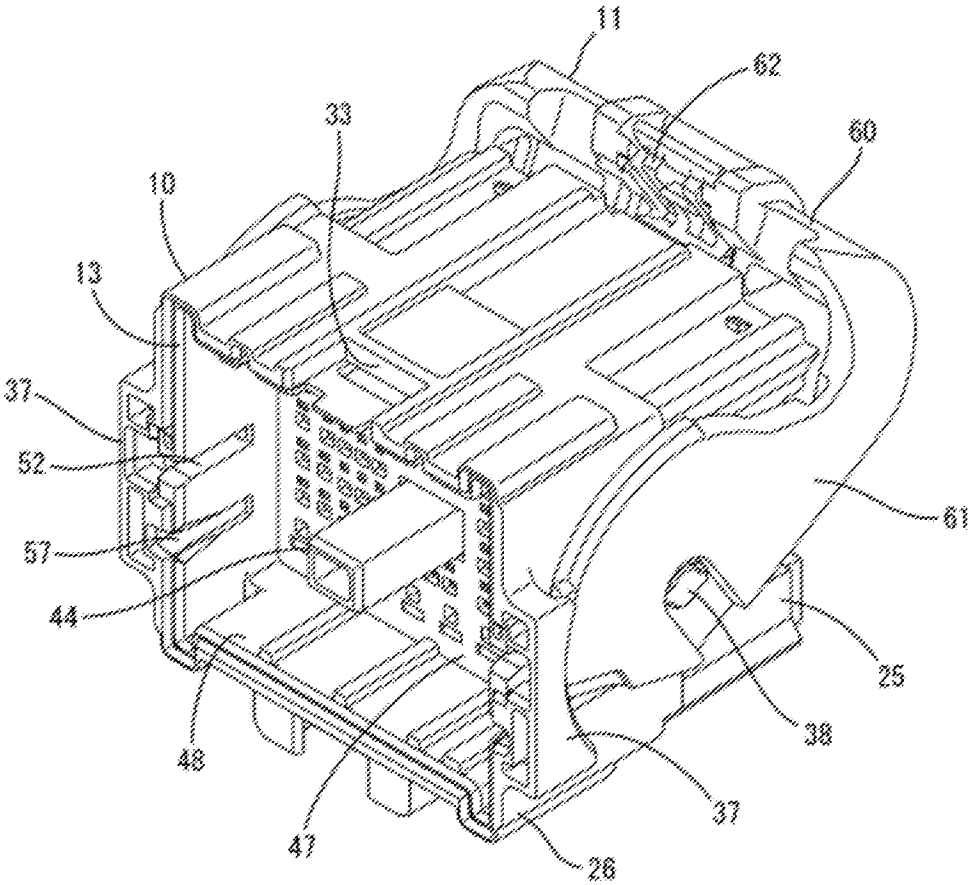
FIG. 2 is a perspective view of the lever-type connector.
Figure 3:
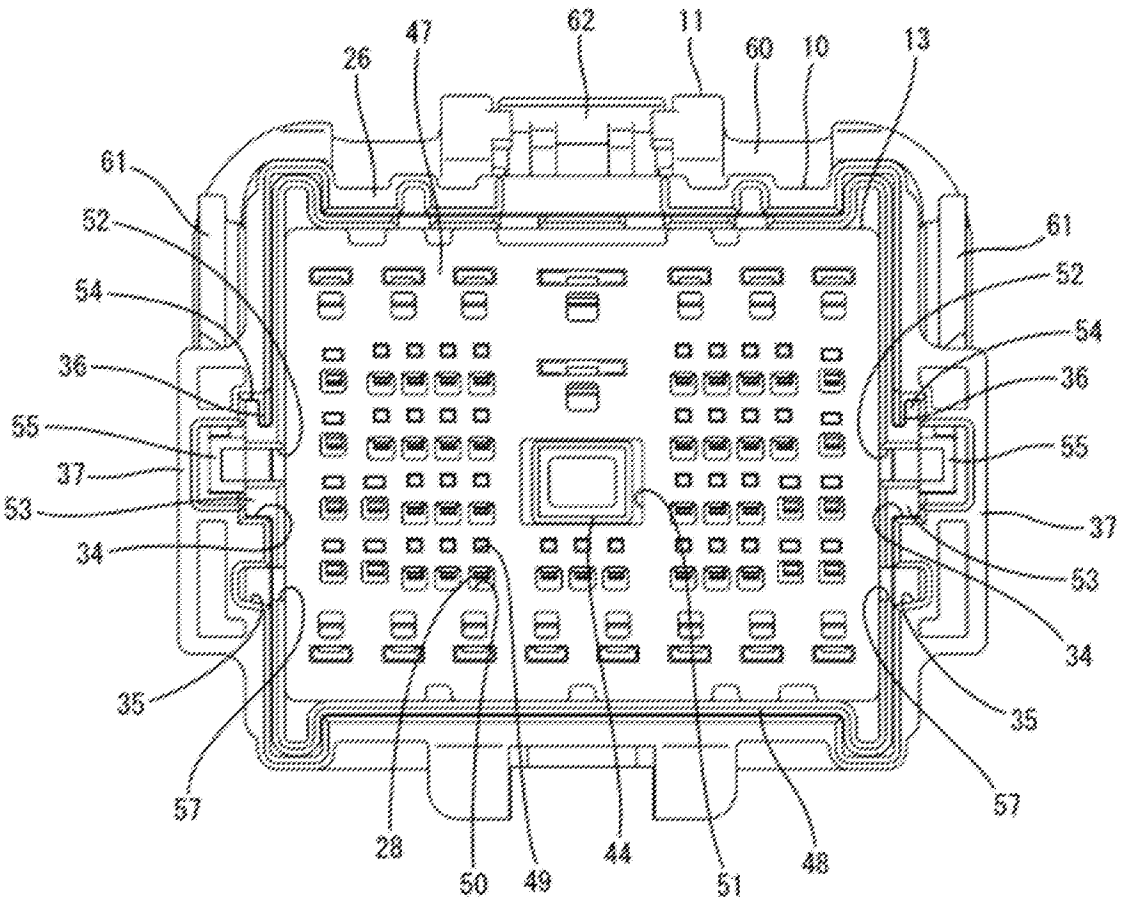
FIG. 3 is a front view of the lever-type connector.
Figure 7:
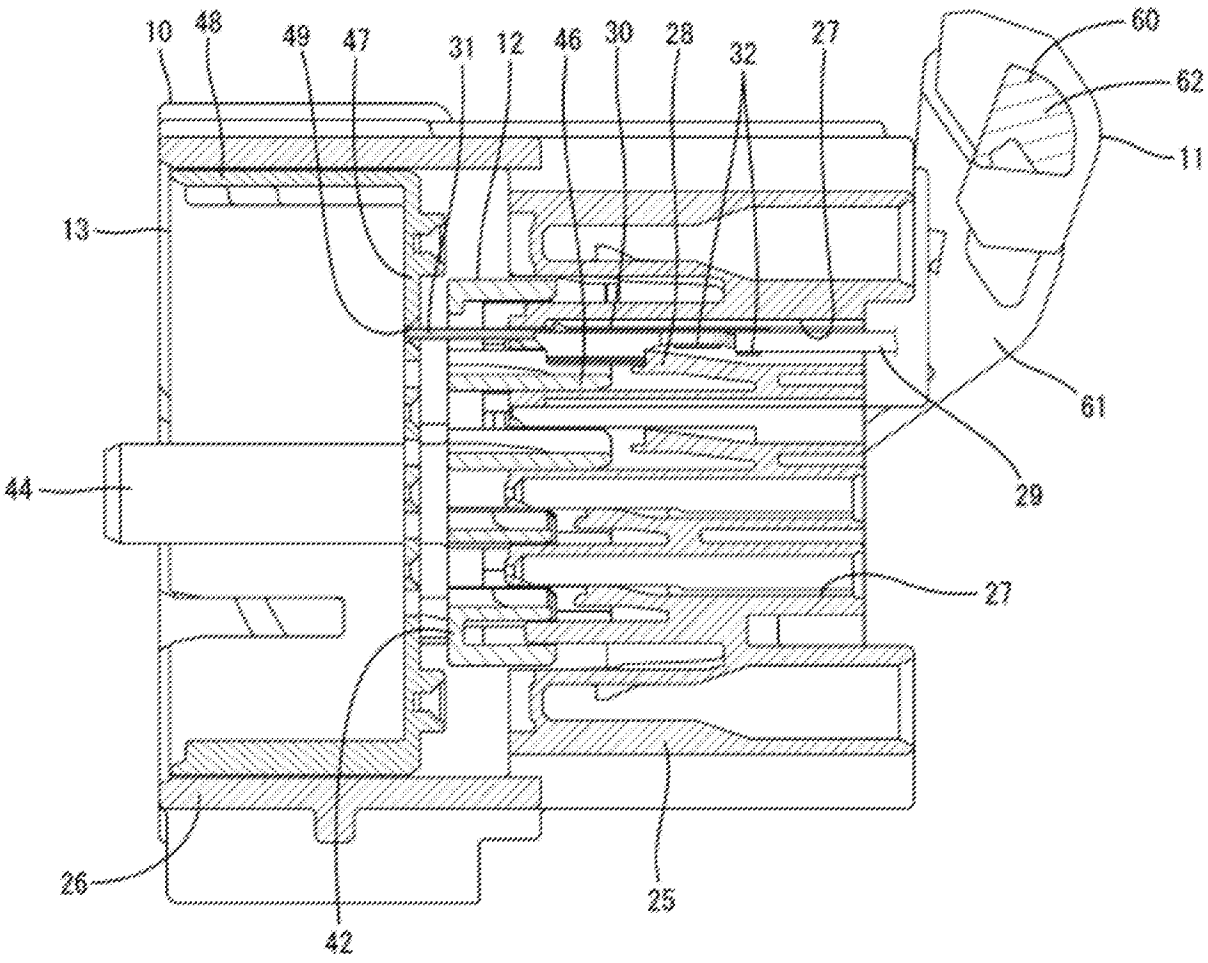
FIG. 7 is a sectional view showing a state in which a moving plate is located at a moving start position with respect to the housing.

The housing 10 is made e.g. of a synthetic resin, as shown in FIG. 2, and has a substantially rectangular block-like housing main body 25 and/or a substantially cylindrical hood or receptacle 26 projecting forward from the outer periphery of the front end of the housing main body 25. As shown in FIG. 7, cavities 27 are disposed in the housing main body 25 and are aligned in the vertical directions and/or the horizontal directions. Male terminal fittings 30 are inserted from the back into the respective cavities 27. Each cavity 27 has flexible lance 28.

Each male terminal fitting 30 is shaped integrally or unitarily by bending, folding and/or embossing to a conductive metal plate. As shown in FIG. 7, a tab 31 is formed to project forward from a tubular portion, and a wire connection portion comprising at least one barrel 32 is formed backward of the tubular portion. The lance 28 is locked elastically or resiliently to hold the tubular portion of the male terminal fitting 30 in the cavity 27. The barrel 32 is to be connected mechanically and electrically to an end portion of a wire 29. The tab 31 is to be arranged to project into the hood 26 in a state in which the male terminal fitting 30 is contained or arranged in the cavity 27.

As shown in FIG. 2, a fitting concave portion 33 is defined by a cutout at the front end of the upper wall of the hood 26 and a substantially intermediate portion thereof in the horizontal directions.

Figure 13:
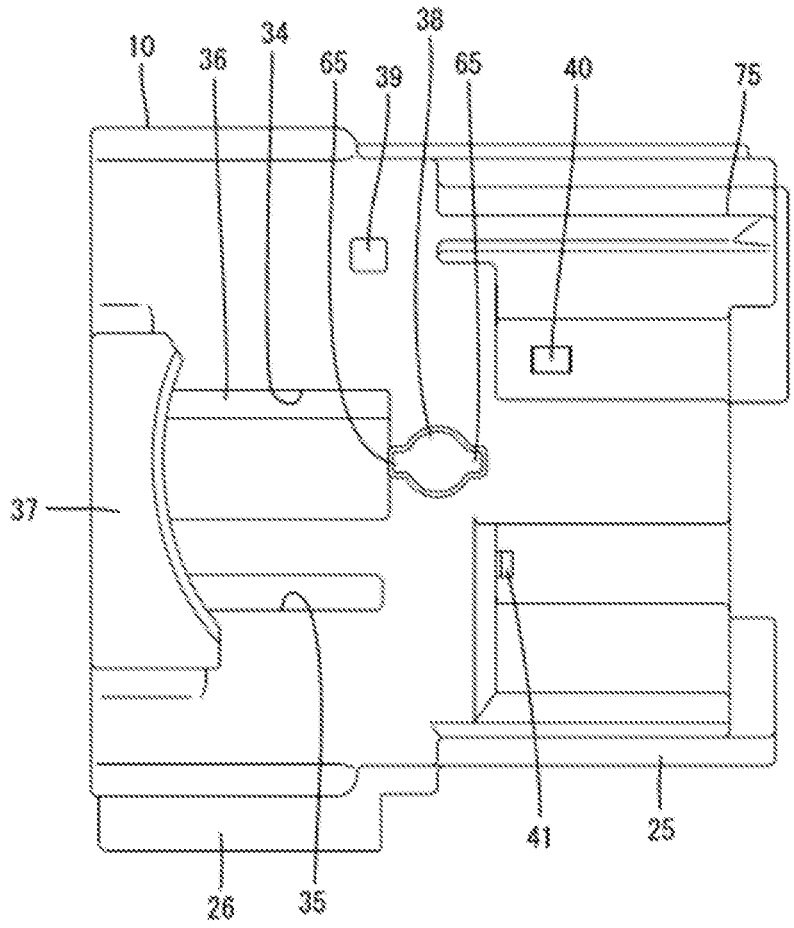
FIG. 13 is a side view of the housing.

Forwardly open moving guide grooves 34 extend in the forward and backward directions at a vertically intermediate portions on both side walls of the hood 26, as shown in FIG. 1 and FIG. 13. Similarly, forwardly open canceling guide grooves 35 extend in forward and backward directions at a lower portion of each side wall. The vertical width of each moving guide groove 34 is larger than the width of each canceling guide groove 35. As shown in FIG. 13, a thin ridge receiving portion 36 is formed inside the upper edge of each moving guide groove 34 in the plate-thickness directions and extends in the forward and backward directions. Outer walls 37 cover the outer sides of the front portions of the moving guide groove 34 and the canceling guide groove 35 on both side walls of the hood 26.

Support shafts 38 project at a vertically intermediate portion on the outer surfaces of both side walls of the hood 26 and close to the housing main body 25. As shown in FIG. 13, the support shafts 38 have substantially columnar shapes and are arranged substantially at the center of the side surface of the housing 10 when viewed from the side and immediately behind the moving guide groove 34. Interference portions 39 project from upper portions on the outer surfaces of both side walls of the hood 26 and are close to the housing main body 25. Each interference portion 39 has a substantially rectangular-columnar shape and a substantially square section.

As shown in FIG. 13, a full-locking portion 40 and a temporary-locking portion 41 project from each side surfaces of the housing main body 25 and are disposed at intervals in the vertical directions. Specifically, the full-locking portion 40 is arranged above the temporary-locking portion 41 and at a position displaced backward.

Figure 8:
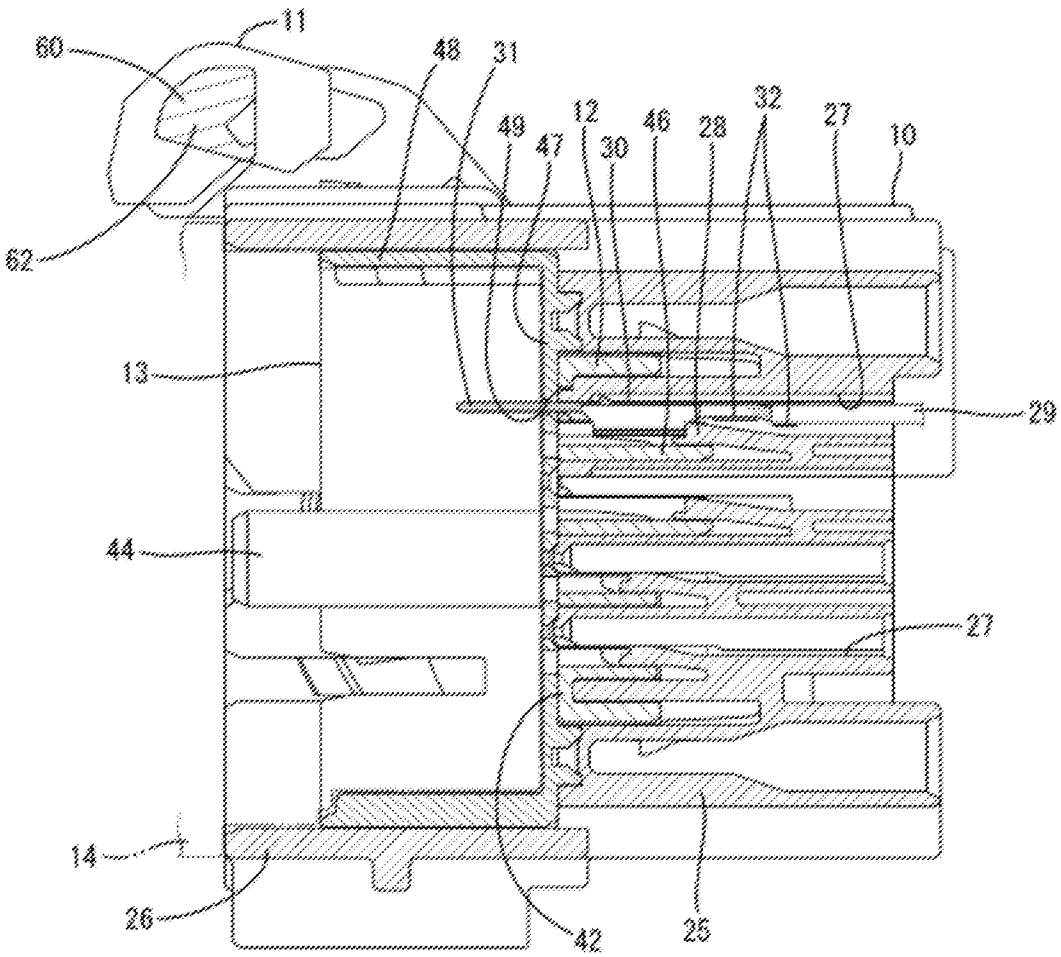
FIG. 8 is a sectional view showing a state in which the moving plate is located at a moving completion position with respect to the housing.
Figure 15:
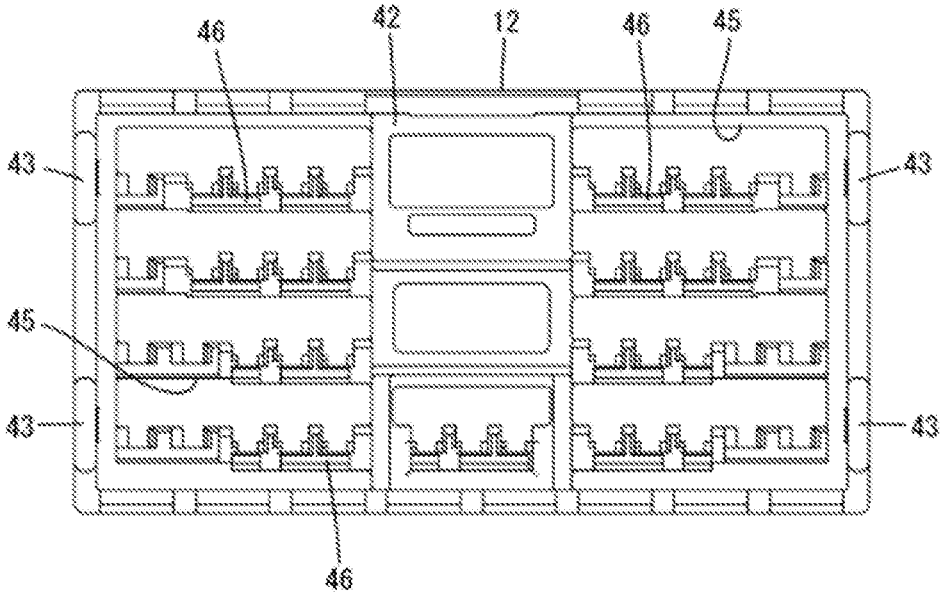
FIG. 15 is a rear view of a front retainer.
Figure 16:
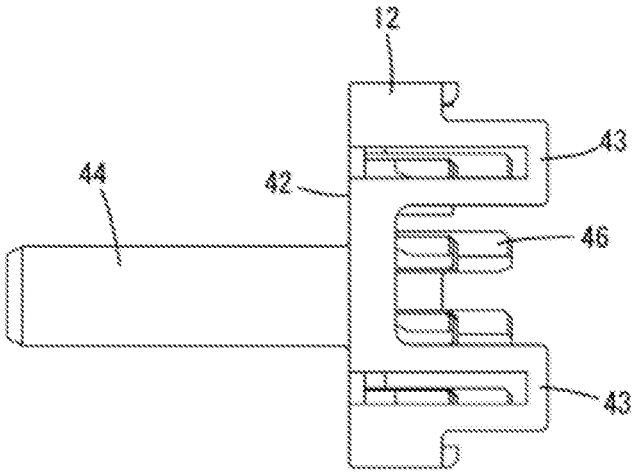
FIG. 16 is a side view of the front retainer.

The front retainer 12 is made e.g. of a synthetic resin and has a substantially rectangular-plate-like front wall 42 extending along the vertical directions. Two resilient locking portions 43 project back from upper and lower positions on both side surfaces of the front wall 42, and at least one substantially square-columnar push prevention portion 44 projects forward from center portion of the front wall 42, as shown in FIG. 15 and FIG. 16. The front retainer 12 can move from a temporary-locking position shown in FIG. 7 to a full-locking position with respect to the housing 10. As shown in FIG. 8, the front wall 42 is arranged to face a part of the back surface of the hood 26 except for the upper and lower end portions. The elastic locking portion 43 has a square-frame shape, and can be deformed flexibly in or out (horizontal directions) by using upper and lower ends connected to the front wall 42 as supports.

As shown in FIG. 15, windows 45 are open in the front wall 42 and communicate respectively with the cavities 27 of the housing main body 25. Specifically, the windows 45 are disposed at plural levels in the vertical directions to correspond to the levels of the cavities 27 to form narrow openings that are long in the horizontal directions. Bending controlling plates 46 project back from the lower sides of the windows 45 of the front wall portion 42. As shown in FIG. 8, when the front retainer 12 is located at a full-locking position, the bending regulating plates 46 enter the bending spaces of the lances 28 to regulate the bending operation of each of the lances 28. In this manner, a state in which the lances 28 are locked on the male terminal fitting 30 is maintained.

The moving plate 13 is made e.g. of a synthetic resin and is moveable forward and backward in the hood between a moving start position shown in FIG. 7 and a moving completion position shown in FIG. 8. The moving plate 13 has a substantially rectangular-planar plate main body 47 movable substantially vertically and a substantially rectangular tubular peripheral wall 48 substantially projecting forward from the outer periphery of the plate main body 47.

Figure 14:
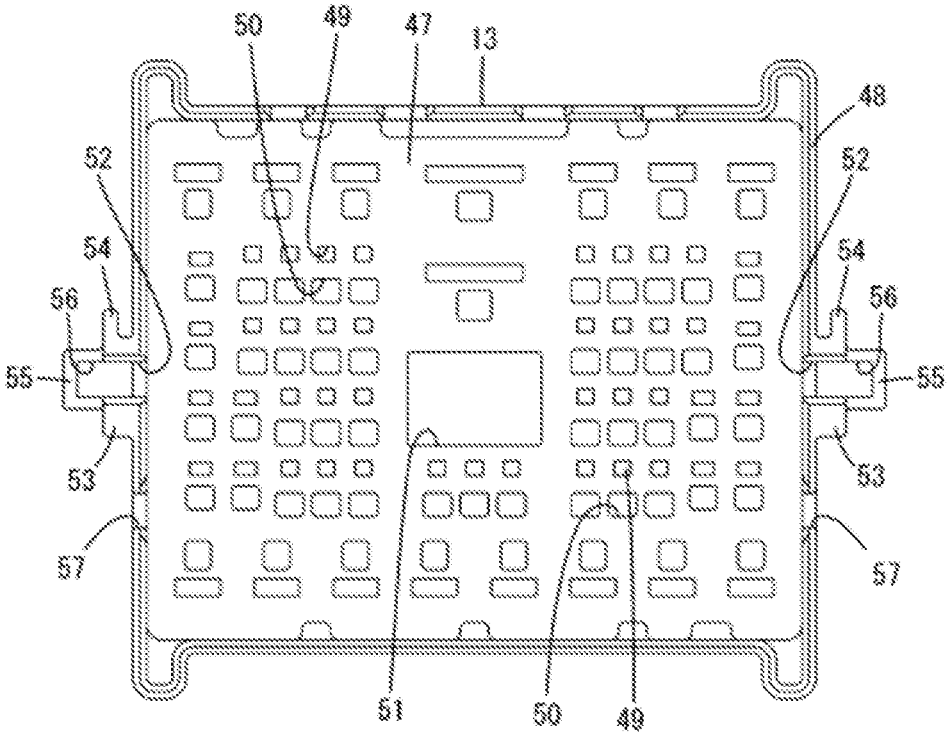
FIG. 14 is a front view of a moving plate.

As shown in FIG. 14, insertion holes 49 are formed in the plate main body 47. The insertion holes 49 are rectangular and are arranged at positions corresponding respectively to the terminal fittings 30. At the moving start position shown in FIG. 7, the plate main body 47 is arranged on the front side of the front wall 42 of the front retainer 12 (back surface of the hood 26), and the distal end of the tab 31 is inserted into the insertion hole 49 so that the tab 31 is protected. On the other hand, at the moving completion position, shown in FIG. 8, the plate main body 47 moves back from the distal end of the tab 31 and approaches or contacts the front wall 42 of the front retainer 12 so that the distal end of the tab 31 is inserted into the insertion hole 49. As shown in FIG. 14, jig insertion holes 50 are formed in the plate main body 47 at lower parts of the insertion holes 49. Furthermore, a substantially rectangular through hole 51 is formed substantially at the center of the plate main body 47.

The outer surface of the peripheral wall 48 has a shape substantially matched with the inner surface of the hood 26. When the moving plate 13 moves, the outer surface of the peripheral wall 48 and the inner surface of the hood 26 slide on each other so that the plate main body 47 displaces in the hood 26 without tilting.

As shown in FIG. 14, forwardly open introduction grooves 52 extend in the forward and backward directions at vertically central portions on both side panels of the peripheral wall 48. Upper and/or lower guide ribs 53 extend in the forward and backward directions along the edges of the introduction grooves 52. A ridge 54 projects up from the upper guide rib 53. U-shaped cams 55 bridge at least partly over the introduction groove 52 at the rear end of each guide rib 53. A coupling space 56 having a rectangular section is defined inside each cam 55 and communicates with the introduction groove 52.

Figure 12:
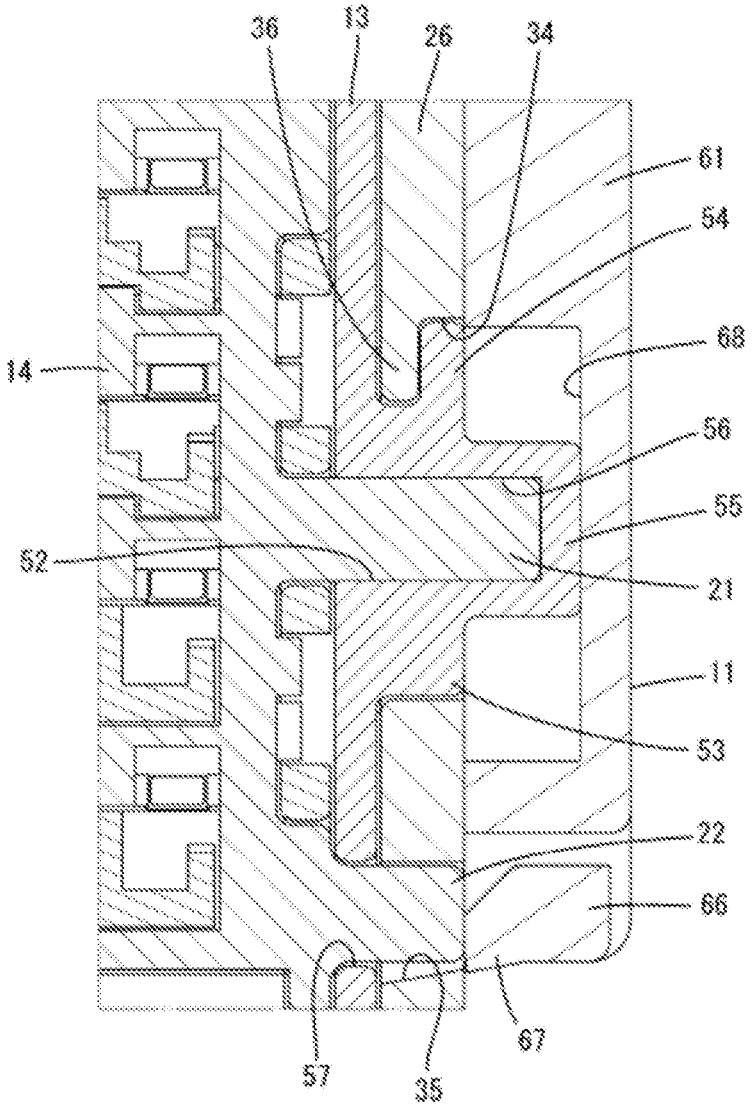
FIG. 12 is an enlarged sectional view showing a state in which both housings are normally fitted on each other, the cam follower is coupled to the cam portion, and a swinging regulation state of a swinging regulation portion is canceled by a canceling portion.

Forwardly open entry grooves 57 are formed in the lower parts of both side panels of the peripheral wall 48 and extend in the forward and backward directions. As shown in FIG. 12, the entry grooves 57 are at a position to communicate with the canceling guide groove 35.

The lever 11 is made e.g. of a synthetic resin, and, as shown in FIG. 1 and FIG. 13, has an operation portion 60 extending laterally or in the substantially horizontal direction and cam plates 61 project from both ends of the operation portion 60 in parallel with each other to form a U-shape when viewed from the front. A lever lock 62 is formed at a laterally intermediate position of the operation portion 60. The lever lock 62 has a rectangular-frame shape and can bent or inclined by substantially using connecting parts of both the left and right ends as supporting points.

Figure 4:
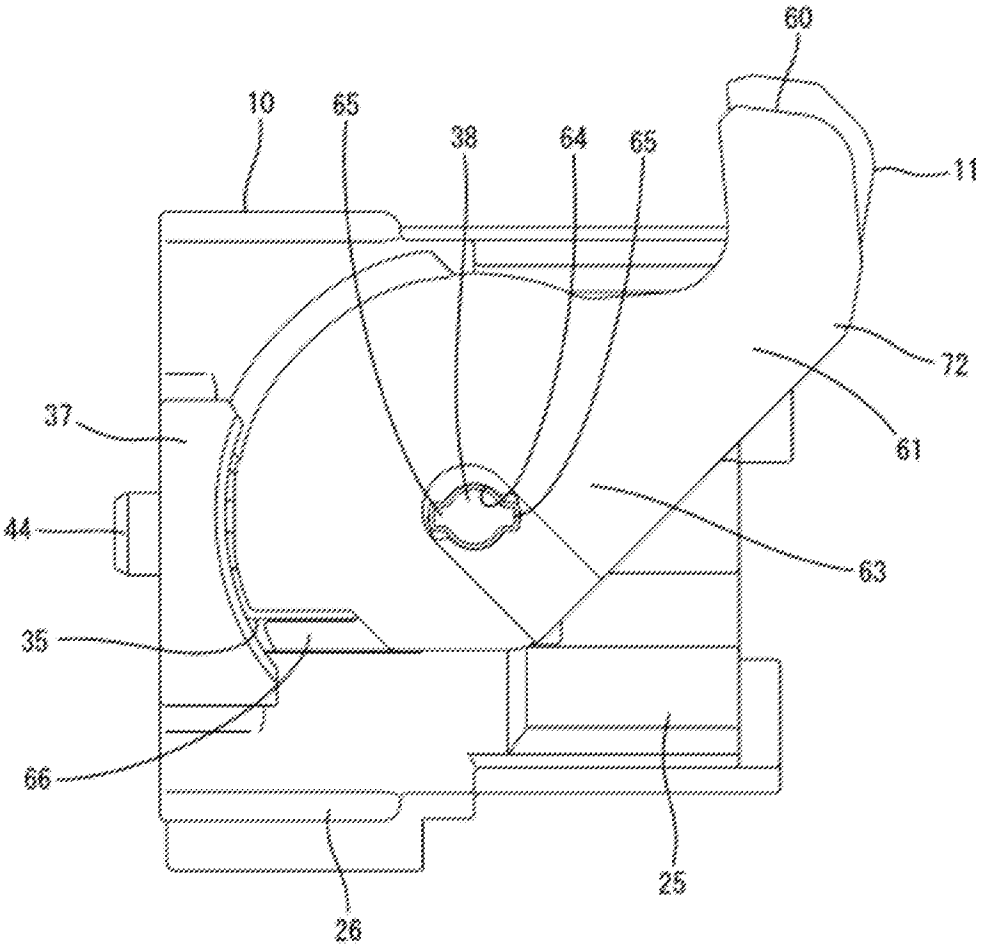
FIG. 4 is a side view showing a state in which a lever is located at a fitting start position with respect to a housing.

Each of the cam plates 61 has an extended region 63 separated from the operation portion 60 and formed with a bearing hole 64. The support shaft 38 is fit in the bearing hole 64 so that lever 11 is supported on the housing 10 such that the lever 11 can be displaced (pivoted) about the support shaft 38, with respect to the housing 10, between the fitting start position and the fitting completion position and/or can be displaced between the fitting start position and the detachment allowing position. As shown in FIG. 4, two retaining pieces overhang from the distal end of the support shaft 38 and can be is brought into contact with the opening peripheral edge on the outer surface side of the bearing hole 64 to regulate or control detachment of the lever 11 from the housing 10. The outer peripheral edge of the extended region 63 of the cam plate 61 is arranged inside the outer wall 37 to regulate or control a wide-opening operation of the cam plate 61.

Swinging regulating cutouts 66 are formed at the outer peripheral edges of the extended regions 63 of the cam plates 61. Each swinging regulating portion 66 is cantilevered forward at the fitting start position. As shown in FIG. 1, at least one locking projection 67 projects in at or near the distal end of the swinging regulating portion 66, Curve cam grooves are formed in the inner surfaces of the extended regions 63 of the cam plates 61. The cam grooves 68 are bottomed grooves closed by the outer surfaces of the cam plates 61 and have inlet ports opening forward in the outer peripheral edge of the cam plates 61 at the fitting start position. As shown in FIG. 1, at least one detachment regulating portion 69 is on the groove bottom surface on the inlet port side in the cam groove 68. Specifically, the detachment regulating portion 69 has an inclined shape with a front surface widely opening outward toward the front and has a vertical-plane shape with a rear surface standing in the directions of plate thickness (horizontal directions) at the fitting start position. One end of the detachment regulating portion 69 is connected to the groove side surface (particularly on the upper side) on the inlet port side of the cam groove 68 of the cam plates 61, and a passing port 70 that allows the cam 55 to pass is formed between the groove side surface (on the lower side) and the other end of the detachment regulating portion 69 to open substantially in the forward and backward directions.

Figure 9:
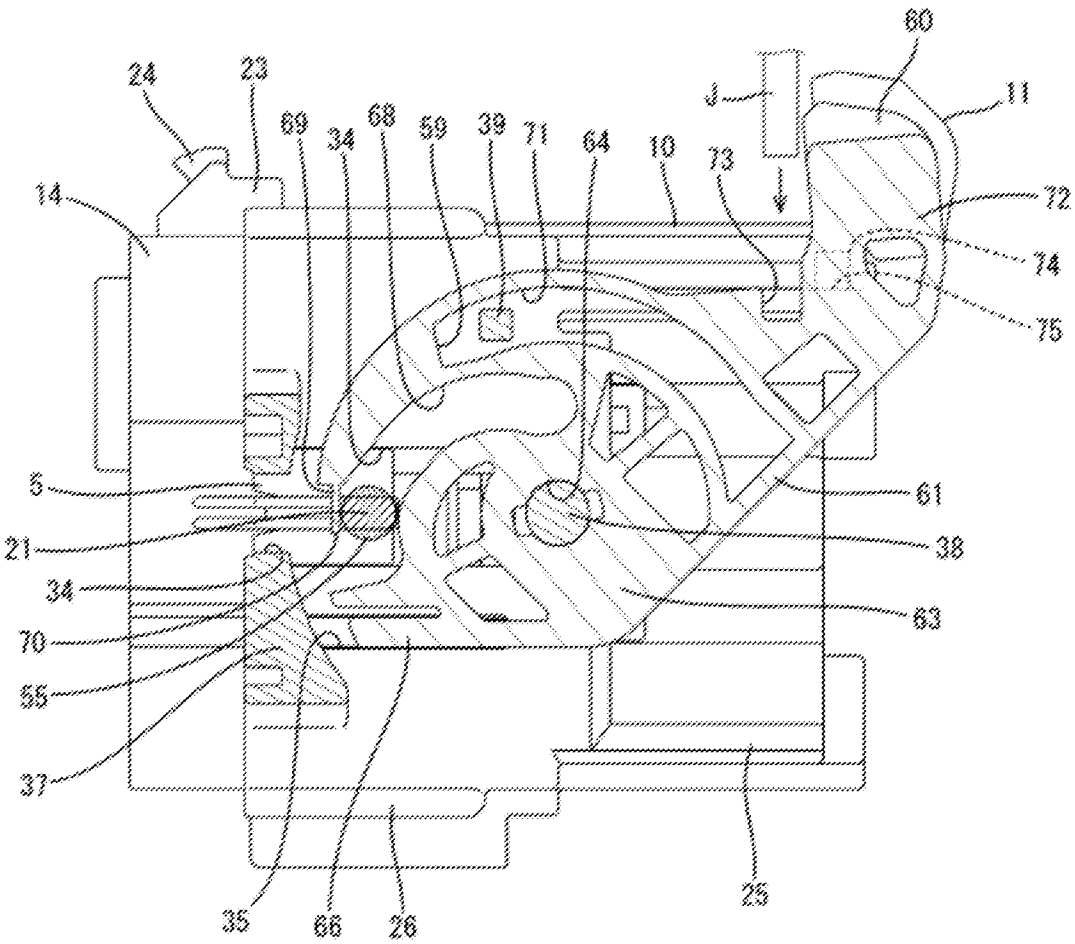
FIG. 9 is a sectional view showing a state in which, when the lever is located at the fitting start position, a cam follower and a cam portion in a coupling state enters on an inlet port side of a cam groove.
Figure 10:
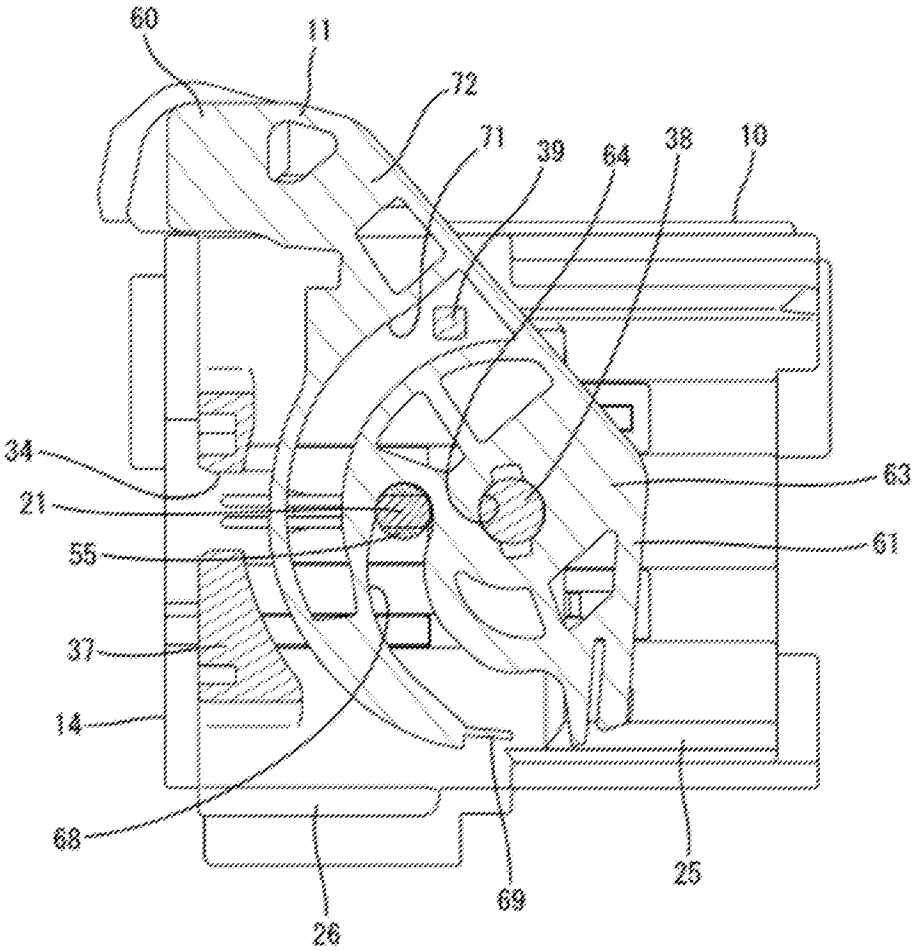
FIG. 10 is a sectional view showing a state in which, when the lever is located at the fitting completion position, the cam follower and the cam portion in the coupling state move on a back side of the cam groove.
Figure 11:
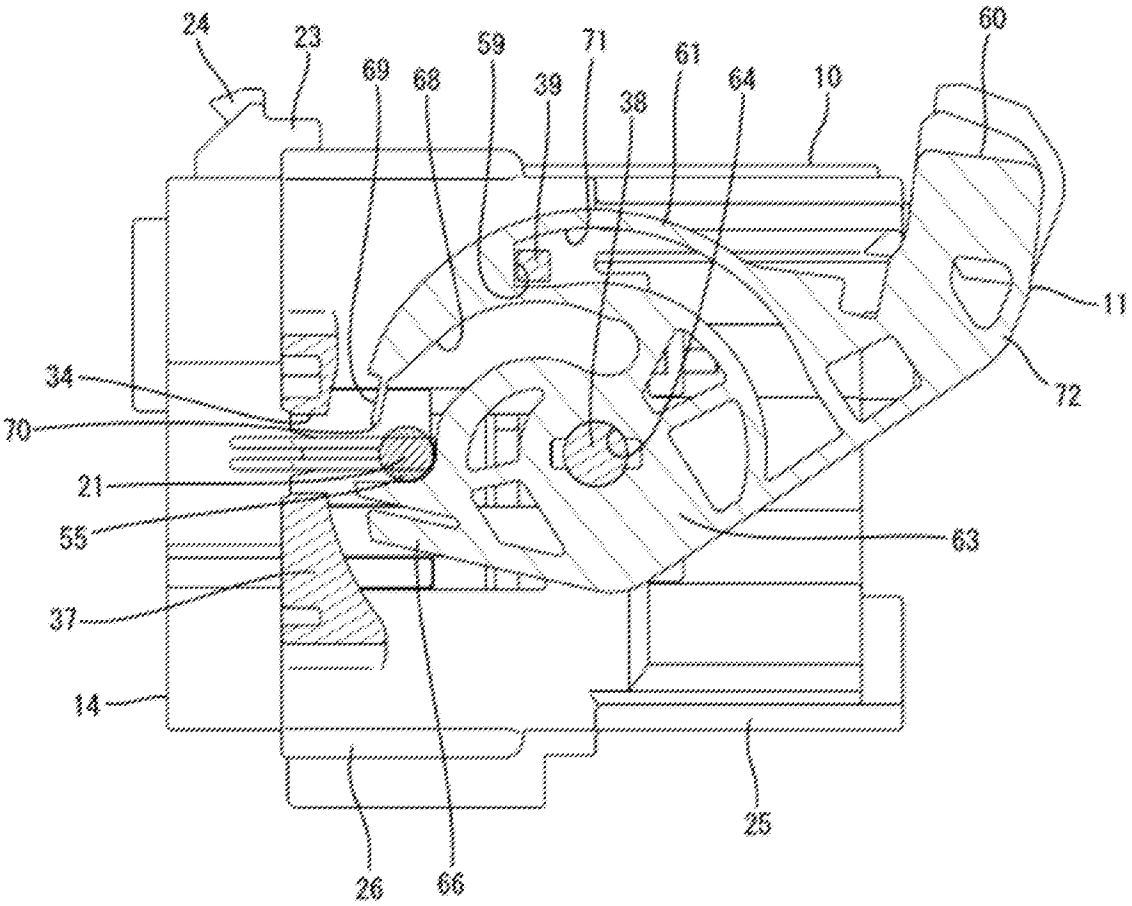
FIG. 11 is a sectional view showing a state in which, when the lever is located at the detachment allowing position, the cam follower and cam portion in the coupling state are separated from a detachment regulating portion.

As shown in FIG. 9, arc-like grooves 71 are formed in the extended region 63 of each of the cam plate 61 and curve substantially along the swinging or pivoting directions of the lever 11. Each arc-like groove 71 is a bottomless or through-passing groove opening in the vertical directions of the cam plate 61, and extends from the outer peripheral edge of the cam plate 61 to a back end located on the rear side of the bearing hole 64. As shown in FIG. 11, the back end of the arc-like groove 71 serves as a hitting surface 59 on the interference portion 39 of the housing 10 and is hit when the lever 11 reaches the detachment allowing position.

As shown in FIG. 1 and FIG. 9, guide grooves 73 are formed on the inner surface of each cam plates 61 in a connecting region 72 between the extended region 63 and the operation portion 60. Each guide groove 73 extends straight in the vertical direction at the fitting start position and opens in the upper end. The back end (lower end) of the guide groove 73 is arranged near an end of the arc-like groove 71. Furthermore, stoppers 74 project in the connecting region 72 on the inner surface of each cam plate 61, at a position near the guide groove 73 and close to the operation portion 60 with respect to the guide groove 73. Specifically, each stopper 74 has a substantially claw-like shape, as shown in FIG. 9, and is locked on the side ends (stopper receiving portion 75) on the rear of the upper surface of the housing main body 25 at the fitting start position. The stopper receiving portion 75 is a part of a planar region substantially continuing in the forward and backward directions at both side ends of the upper surface of the housing main body 25.

An operational advantage of the lever-type connector according to the first embodiment will be described below.

In an assembling operation, the front retainer 12 is held at a temporary locking position. In this state, the male terminal fittings 30 are inserted into the cavities 27 of the housing main body 25 from behind (see FIG. 7). The male terminal fitting 30 is connected to the terminal portion of the wire 29 in advance and is inserted into the cavity 27, so that the male terminal fitting 30 is retained by the lance 28. The front retainer 12 is kept at the temporary locking position so that the temporary locking portion 41 is elastically or resiliently fit in inside the lower elastic locking portion 43. At the temporary locking position, the bending regulating portions 46 are arranged forward of the bending space of the corresponding lance 28 so that each bending regulating portion 46 is separated from the bending space.

The front retainer 12 is pressed into the hood 26 on the back side. Locking between the elastic locking portion 43 and the temporary locking portion 41 is canceled by a pressing force given to the front retainer 12. Thus, the front retainer 12 is displaced to the full locking position, and each bending regulating portion 46 enters into the bending space of the corresponding lance 28 to set the male terminal fitting 30 in a double retaining or locked state. The front retainer 12 is locked at the full locking position so that the full locking portion 40 is fit elastically or resiliently on the inside of the elastic locking portion 43.

The moving plate 13 is inserted into the hood 26. Before the moving plate 13 is inserted, the lever 11 is held or locked at the fitting start position. Displacement of the lever 11 toward the fitting completion position is regulated such that the locking projection 67 of the swing regulating portion 66 is fit elastically or resiliently on the canceling guide groove 35 of the hood 26 and locked on the edge of the canceling guide groove 35 (see FIG. 4). The stopper 74 is brought into contact with the stopper receiving portion 75 to regulate swinging of the lever 11 toward the detachment allowing position (see FIG. 9). At the fitting start position, the operation portion 60 is arranged above the rear end of the housing main body 25. Additionally, the interference portion 39 is inserted into the arc-like groove 71 near the hitting surface 59 but is separated from the hitting surface 59.

Meanwhile, in the process in which the moving plate 13 is inserted into the hood 26, the cam 55 slides on the front surface of the detachment regulating portion 69 to elastically open the cam plate 61 outward. When the moving plate 13 is inserted into the hood 26, the cam plate 61 elastically or resiliently returns, and, accordingly, the cam 55 is inserted into the inlet port of the corresponding cam groove 68 and is arranged such that the cam 55 can be locked on the rear surface of the detachment regulating portion 69 (see FIG. 9). In this manner, the moving plate 13 is kept at the moving start position in a state in which the detachment of the moving plate 13 from the hood 26 can be controlled at the moving start position.

The guide portion 53 is fit on and inserted into the corresponding moving guide groove 34, and the ridge receiving portion 36 is fit on and inserted between the ridge 54 and the outer surface of the peripheral wall 48. Thus, the moving plate 13 is guided to move in the forward and backward directions (see FIG. 3). Furthermore, the push prevention portion 44 is positioned to the through hole 51 of the moving plate 13 and at least partly inserted therein.

In the above state, the counterpart housing 14 is fit lightly or shallowly in the hood 26. At this time, when the housings 10 and 14 that face each other are tilted, the distal end of the push prevention portion 44 contacts the wall surface facing the counterpart housing 14, and the fitting operation between the housings 10 and 14 is controlled so that the counterpart housing 14 does not push the male terminal fittings 30. On the other hand, when the housings 10 and 14 are fit normally, the push prevention portion 44 is positioned to the counterpart front retainer 17 and the push prevention receiving portion 20 of the counterpart housing 14 is inserted therein so that the fitting operation between the housings 10 and 14 is performed appropriately.

When the counterpart housing 14 is fit shallowly in the hood 26, the cam follower 21 enters the coupling space 56 in the cam 55 and then hits and is stopped by the back end of the introduction groove 52 (see FIG. 12). In this manner, the cam follower 21 and the cam 55 are coupled to and integrated with each other. Furthermore, the canceling portion 22 is inserted into the canceling guide groove 35 and interferes with the locking projection 67. Additionally, the regulating portion 66 is deformed out to cancel locking between the locking projection 67 and the edge of the canceling guide groove 35. In this manner, the pivoting or the displacement of the lever 11 toward the fitting completion position can be performed.

Figure 5:
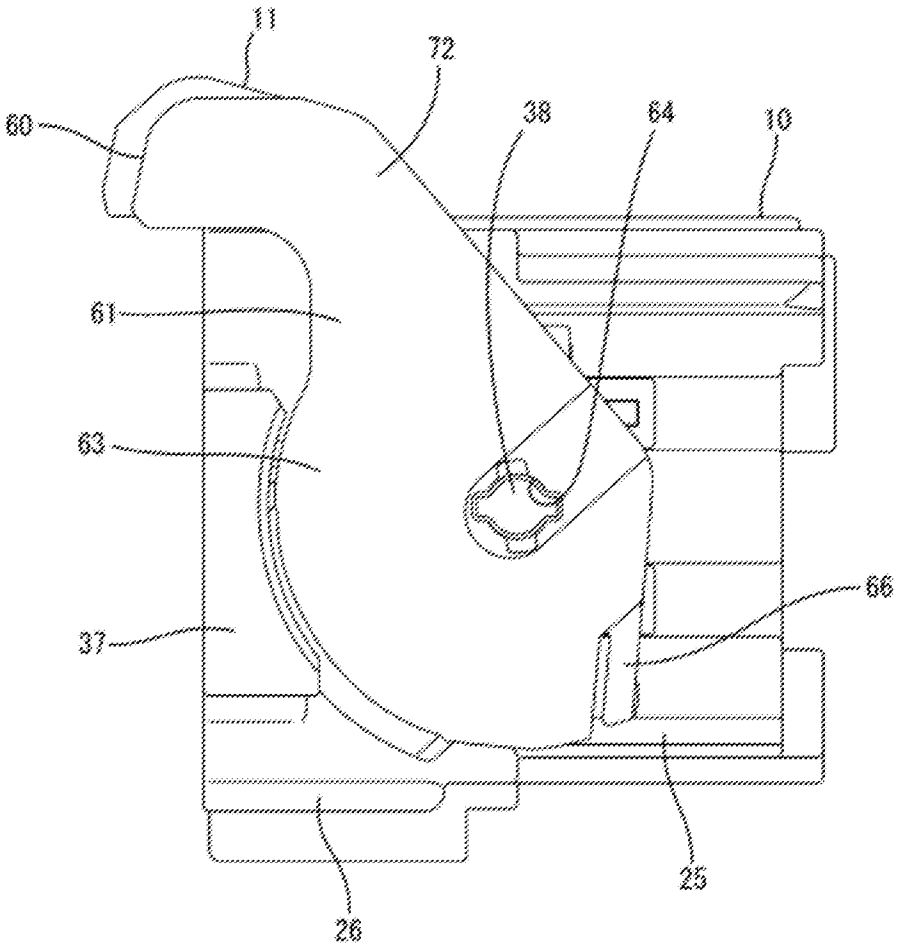
FIG. 5 is a side view showing a state in which the lever is located at a fitting completion position with respect to the housing.
Figure 6:
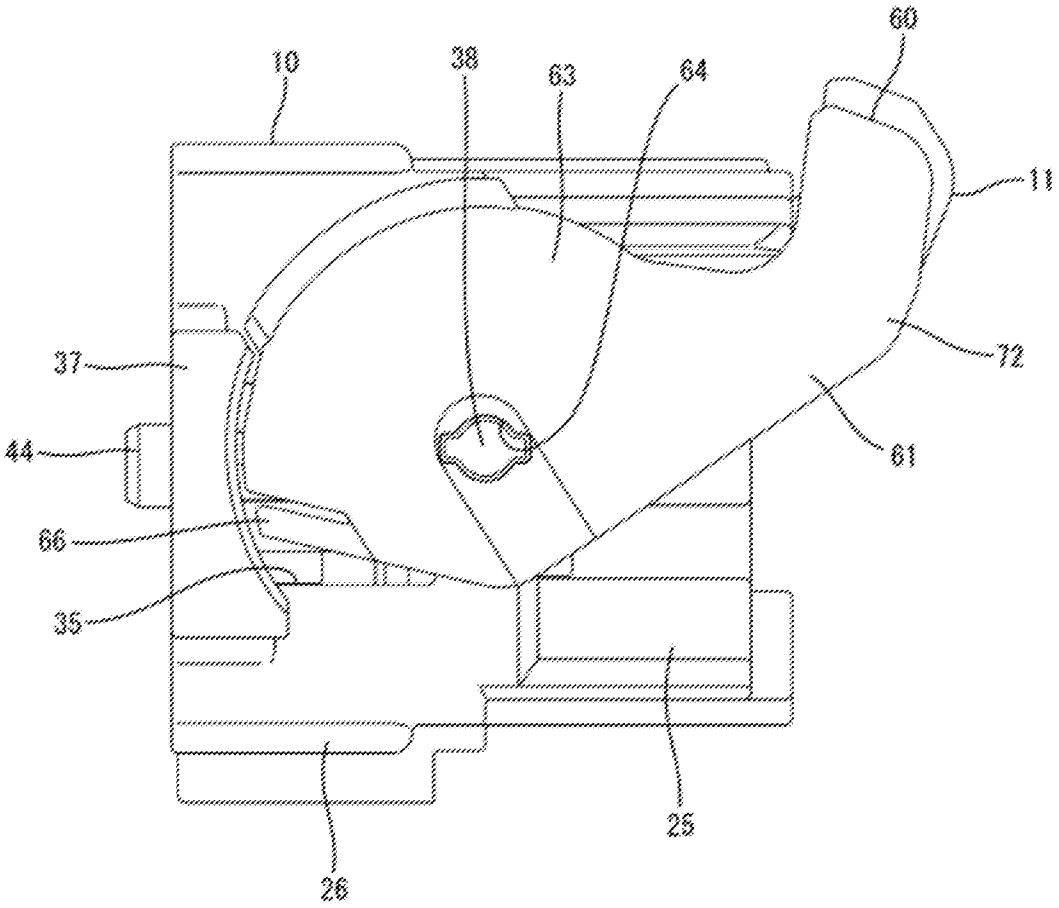
FIG. 6 is a side view showing a state in which the lever is located at a detachment allowing position with respect to the housing.

The operation portion 60 then is held, and the lever 11 is pivoted toward the fitting completion position (see FIG. 4 and FIG. 5). The pivoting of the lever 11 causes the coupled assembly of the cam follower 21 and the cam 55 to slide on the groove surface of the cam groove 68, and the cam action between the counterpart housing 14 and the lever 11 displaces the counterpart housing 14 to the back of the hood 26. In addition, the cam 55 is displaced in the cam groove 68 to move the moving platel3 toward the moving completion position (back of the hood 26). At this time, the ridge 54 slides on the ridge receiving portion 36 to move and guide the moving plate 13.

The lock 23 of the counterpart housing 14 is fit into the fitting concavity 33 when the cam follower 21 and the cam 55 in the coupling state reach the back end of the cam groove 68. Additionally, the lever lock 62 of the operation portion 60 is locked elastically or resiliently on the projection 24 of the lock 23 to control the swinging operation of the lever 11. In this manner, the lever 11 is kept at the fitting completion position in the swinging regulating state.

The interference portion 39 is close to one end of the arc-like groove 71 when the lever 11 reaches the fitting completion position, and the plate main body 47 of the moving plate 13 approaches the front wall 42 of the front retainer 12 so that the front wall 42 is sandwiched or located between the plate main body 47 and the back surface of the hood 26 (see FIG. 8). The tabs 31 of the male terminal fittings 30 project forward from each of the insertion holes 49 and electrically connect to each of the female terminal fittings contained in the counterpart housing 14. In this manner, both the housings 10 and 14 are kept in the normal or regular fitting state.

On the other hand, the male terminal metal piece 30 may have to be removed from the cavity 27 after the locking between the lever lock 62 and the lock 23 is canceled In this case, the lever 11 is displaced toward the fitting start position while the operation portion 60 is held or operated. Displacement of the lever 11 toward the fitting start position moves the cam 55 on the inlet port side of the cam groove 68 to move the moving plate 13 toward the moving start position.

After the lever 11 returns to the fitting start position, a jig J is inserted into the guide groove 73 of the lever 11 (see FIG. 9). The jig J has a pin-like shape or a rod-like shape substantially corresponding to the shape of the guide groove 73, has a distal end inserted into the guide groove 73 from the upper surface opening thereof and can be displaced straight downward along the surface of the guide groove 73. At this time, the cam plate 61 is pressed by the jig J and resiliently opens widely out by using the connection to the operation portion 60 as a support. The stopper 74 can be separated from the stopper receiving portion 75 when the cam plate 61 is opened and the lever 11 can be pivoted toward the detachment allowing position.

The lever 11 is pivoted in a direction opposite to the direction from the fitting start position to the fitting completion position and is brought to the detachment allowing position. When the lever 11 reaches the detachment allowing position, the interference portion 39 contacts the hitting surface 59 of the arc-like groove 71 to control further swinging of the lever 11 away the fitting start position (see FIG. 11). In the process of displacing the lever 11 to the detachment allowing position, the cam 55 is displaced on the inlet port side from the detachment regulating portion 69 toward the passing port 70 side. When the lever 11 reaches the detachment allowing position, the entire cam 55 is released from the detachment regulating portion 69 and moves to the passing port 70 side. In this manner, the state in which the moving plate 13 at the moving start position is detached from the hood 26 can be obtained.

The moving plate 13 can be removed forward from the hood 26 when the lever 11 is at the detachment allowing position, and subsequently, the front retainer 12 can be removed forward from the hood 26. Thereafter, a terminal removing jig (not shown) is engaged with the lance 28 facing the back surface of the hood 26, and the lance 28 is deformed by the terminal removing jig substantially in the locking canceling direction (e.g. down in the drawing). In this state, the wire 29 connected to the male terminal metal piece 30 is drawn backward to remove the male terminal fitting 30 from the cavity 27.

In this manner, when the lever 11 is at the detachment allowing position, the cam 55 is separated from the detachment regulating portion 69 to set a state in which the moving plate 13 can be detached from the hood 26. For this reason, even though the lever 11 is removed from the housing 10, the moving plate 13 can be detached from the hood 26 to make it possible to perform the removing operation of the male terminal fittings 30. Thus, the cumbersome removing operation of the lever 11 need not be performed, so that a workload can be reduced.

A jig insertion hole into which a terminal removing jig is inserted is not formed easily in the front retainer 12. Thus, the removing operation of the male terminal fitting 30 is performed advantageously while the lever 11 is attached to the housing 10.

The locking between the stopper receiving portion 75 and the stopper 74 is maintained to prevent the lever 11 from being displaced unexpectedly from the fitting start position to the detachment allowing position. When the locking between the stopper receiving portion 75 and the stopper 74 is to be canceled, the cam plate 61 need only be deformed by the jig J. For this reason, the canceling operation can be performed easily. Furthermore, the guide groove 73 extends straight and opens on the outer surface of the cam plate 61 to guide the jig J when displacing the cam plate 61. The jig J is applied only along the guide groove 73 so that the cam plate 61 easily can be deformed elastically.

Furthermore, the arc-like groove 71 is formed in the lever 11 and curves substantially along the swinging directions of the lever 11. Additionally, the interference portion 39 of the housing 10 is brought into contact with the hitting surface 59 at the back end of the arc-like groove 71 at the detachment allowing position. In this state, the lever 11 stops at the detachment allowing position, and the detaching operation of the moving plate 13 can be started smoothly and rapidly.

The invention is not limited to the embodiment described with reference to the drawings. For example, the following embodiments are included in the scope of the invention.

At least one of a cam follower and a cam in a coupling state may only slide on the groove surface of a cam groove to exert a cam action.

A guide groove may be formed in a housing or may be formed both a cam plate and the housing.

A cam groove may have a bottomless shape penetrating a cam plate in a direction of plate thickness.

A lever may have a single-plate shape configured by only one cam plate.

A detachment regulating portion, a guide groove, a stopper, and/or a stopper receiving portion may be singly disposed.

REFERENCE SIGNS

10 . . . housing
11 . . . lever
12 . . . front retainer
13 . . . moving plate
14 . . . mating housing
21 . . . cam follower
26 . . . hood
28 . . . lance
30 . . . male terminal fitting
31 . . . tab
39 . . . interference portion
46 . . . bending controlling portion
49 . . . insertion hole
55 . . . cam
59 . . . hitting surface
61 . . . cam plate
68 . . . cam groove
69 . . . detachment regulating portion
70 . . . passing port
71 . . . arc-like groove
73 . . . guide groove
74 . . . stopper
76 . . . stopper receiving portion
J . . . jig

What is claimed is:

1. A lever-type connector comprising:

a housing having a hood with an entrance into which a mating housing can be fit, at least one tab of a male terminal fitting projecting into the hood;

a moving plate movable between a moving start position and a moving completion position in the hood, having at least one insertion hole into which the tab is inserted so that the tab projects forward from the insertion hole when the moving plate moves from the moving start position to the moving completion position, and having at least one cam to be coupled to a mating cam element provided at the mating housing; and a lever supported to be displaced sequentially from a detachment allowing position to a fitting start position and then to a fitting completion position with respect to the housing, the lever having an inlet port at an outer periphery of the lever and configured to allow passage of the cam and the mating cam element when the lever is at the detachment allowing position, a cam groove communicating with the inlet port and configured to move the cam and the mating cam element as the lever moves between the fitting start position and the fitting completion position to connect the housing and the mating housing, and at least one detachment regulating portion between the inlet port and the cam groove and configured for locking the cam and the mating cam element at the fitting start position to control detachment of the moving plate from the hood, wherein the lever is displaced from the fitting start position in a direction away from the fitting completion position and to the detachment allowing position at which the cam element is separated from the detachment regulating portion to allow the moving plate to detach from the hood.

2. The lever-type connector of claim 1, wherein at least one stopper receiving portion is disposed at a position on the housing remote from the entrance to the hood, at least one stopper disposed on at least one cam plate of the lever and locked on the stopper receiving portion when the lever is at the fitting start position and controlling displacement of the lever to the detachment allowing position, and the cam plate is elastically deformed to cancel locking between the stopper receiving portion and the stopper.

3. The lever-type connector of claim 2, wherein at least one of the cam plate of the lever and the housing has at least one guide groove in proximity to at least one of the stopper and the stopper receiving portion and extending substantially straight and opening on an outer surface to guide a jig to elastically displace the cam plate and disengage the stopper and the stopper receiving portion.

4. The lever-type connector of claim 3, wherein the lever has an operating portion and the at least one cam plate comprises two opposed cam plates extending from spaced apart positions on the operating portion, at least one of the cam plates being formed with the cam groove, the inlet port and the detachment regulating portion.

5. The lever type connector of claim 4, wherein the at least one stopper is in proximity to the operating portion of the lever.

6. The lever-type connector of claim 3, wherein the guide groove extends substantially perpendicular to a mating direction of the lever-type connector and the mating connector when the fitting start position.

7. The lever-type connector of claim 1, wherein at least one flexible lance retaining and locking the male terminal fitting is disposed at the housing.

8. The lever-type connector of claim 7, further comprising a front retainer having at least one bending controlling portion controlling a bending operation of the lance is to be arranged in the hood so that at least part of the front retainer is sandwiched between a plate surface of the moving plate and a back surface of the hood.

9. The lever-type connector of claim 1, wherein at least one arc-like groove curved along a swinging direction of the lever is formed in the lever, and an interference portion is disposed in the housing and is brought into contact with a back end of the arc-like groove at the detachment allowing position to control a further swinging operation of the lever.

10. The lever-type connector of claim 9, wherein the back end of the arc-like groove serves as a hitting surface on the interference portion of the housing that is struck when the lever reaches the detachment allowing position.

11. A lever-type connector assembly comprising the lever-type connector of claim 1 and a mating connector having a mating housing at least partly insertable into the hood of the housing.

* * * * *